United States Patent [19]

Coker

[11] Patent Number: 4,588,499

[45] Date of Patent: May 13, 1986

[54] GRAVITY FLOW AMALGAMATOR

[76] Inventor: Earnest Z. Coker, 1525 SW. 23, Oklahoma City, Okla. 73108

[21] Appl. No.: 735,413

[22] Filed: May 17, 1985

Related U.S. Application Data

[63] Continuation-in-part of Ser. No. 637,091, Sep. 2, 1984, abandoned.

[51] Int. Cl.[4] ..... B03B 5/60

[52] U.S. Cl. ..... 209/189; 209/42; 209/205

[58] Field of Search ..... 209/42, 189, 190, 205, 209/203, 201, 194, 192, 188, 186, 184, 183

[56] References Cited

U.S. PATENT DOCUMENTS 669,671 4/1901 Tobin ..... 209/188 X 779,365 1/1905 Kelley ..... 209/183 X

*Primary Examiner*—Frank W. Lutter
*Assistant Examiner*—Thomas M. Lithgow
*Attorney, Agent, or Firm*—Robert K. Rhea

[57] ABSTRACT

In a gravity flow amalgamator an elongated upright housing is provided with a removable bottom end tray containing a bath of mercury for collecting gold. A pair of partition walls extend inward and downwardly in parallel relation transversely of the housing to form a water channel downstream tortuous path characterized by return bends with each wall of the pair of walls respectively attached to the inner surface of the housing opposing side walls intermediate their height to define fluid compartments at opposite sides of the housing. The water channel discharges the water into one of the fluid compartments.

3 Claims, 2 Drawing Figures

GRAVITY FLOW AMALGAMATOR

This application is a continuation-in-part of an application filed by me in the United States Patent and Trademark Office for GRAVITY FLOW AMALGAMATOR on Sept. 2, 1984, Ser. No. 06/637,091 now abandoned.

BACKGROUND OF THE INVENTION

1. Field of the Invention

The present invention relates to gold recovery and more particularly to an amalgamating apparatus for collecting gold dust or gold particles suspended in water.

In gold recovery by the sluice method gold ore, as from a stream bed, is passed with water over a plurality of different sized screen covered receptacles so that heavy and larger particles are removed from the ore and small particles fall by gravity with the water through the screens. In this method minute gold particles are maintained in suspension in the water and are normally lost.

2. Description of the Prior Art

U.S. Pat. No. 669,671 discloses a gravity amalgamator for separating gold particles from normally dry ore by the static head of a column of such ore through a housing forcing the ore through a bath of mercury. The column head may be increased when necessary by adding water. The heavier amalgamated mercury and gold settles by gravity to the bottom of a removable receptacle for recovery of the gold as by evaporating the mercury.

This invention is distinguished over the above patent by providing an upwardly and downwardly open housing into which a stream of water, containing gold in suspension, is moved by gravity from an elevated position in which the water flowing through the housing follows a tortuous path terminating adjacent the level of a bath of mercury contained by the depending limit of the housing. The mercury is substantially transversely divided by the walls forming the water path so that all water exiting the housing must pass through the mercury.

SUMMARY OF THE INVENTION

An upright housing, having vertical walls defining an open top and open bottom, is provided with a mercury filled bottom tray normally closing the depending end of the housing. Partition walls extend transversely inward and downwardly from opposing sides of the top of the housing and are spaced-apart a selected distance to cooperatively form a transverse tortuous path progressing downwardly from the housing top to the bottom tray. A trough guides fluid into the entrance of the housing tortuous path through a screen overlying the open top. The water path is defined by return bends with one wall of at least one return bend transversely contacting and secured to the inner surface of the respective housing side wall intermediate its height to define at least one fluid chamber or compartment adjacent the respective side wall with the mercury bath forming the lower limit of the fluid compartment. One wall of the lowermost return bend intersects and extends downwardly into the mercury bath and terminates in spaced relation with respect to the tray bottom to form a baffle between the two housing fluid compartments. The fluid path terminates in one of the housing compartments and the water is forced from one fluid compartment through the mercury to exit the other housing compartment by an outlet in the housing side wall. An impeller in the housing supplements the velocity of water flow as needed.

The principal object of this invention is to provide an amalgamating apparatus for amalgamating gold from fresh or salt water.

DESCRIPTION OF THE PREFERRED EMBODIMENT

Figure 2:
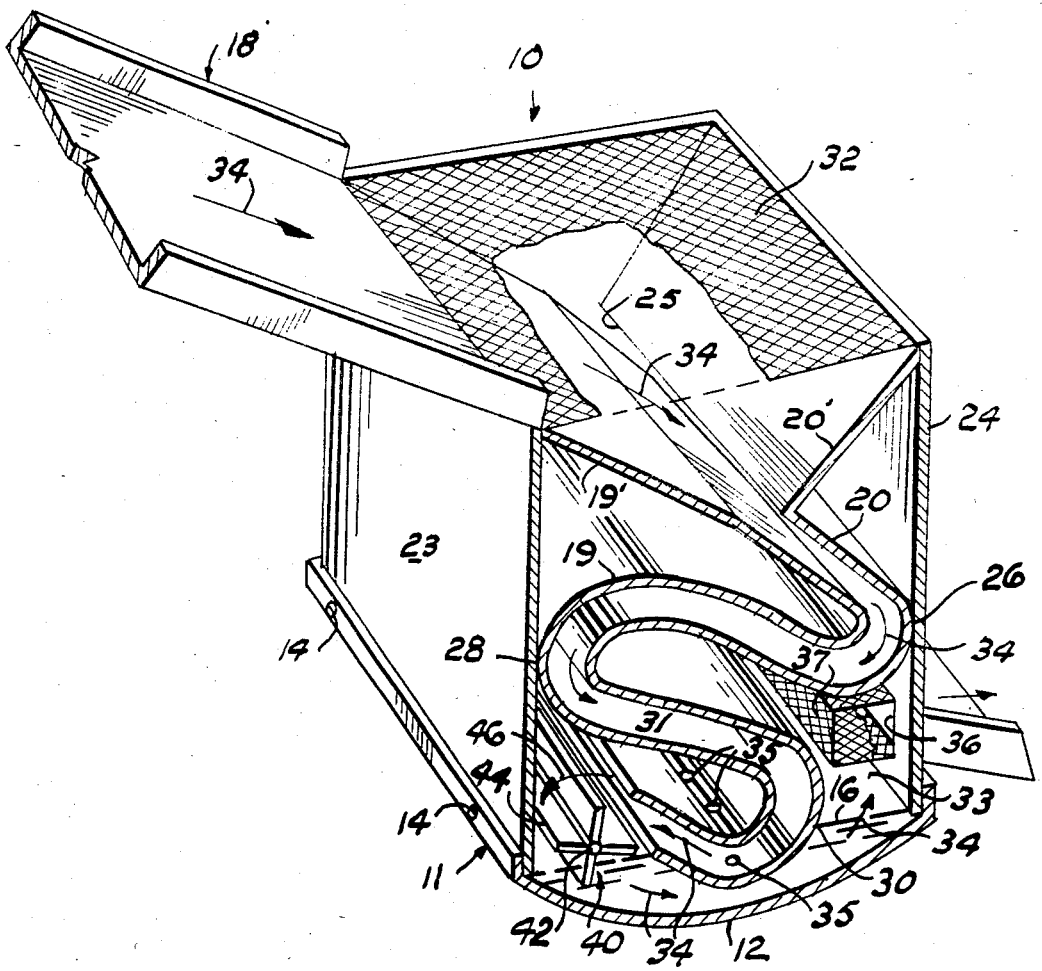
FIG. 2 is a vertical cross section and perspective view of the apparatus, to a larger scale, taken substantially along the line 2—2 of FIG. 1.
Figure 1:
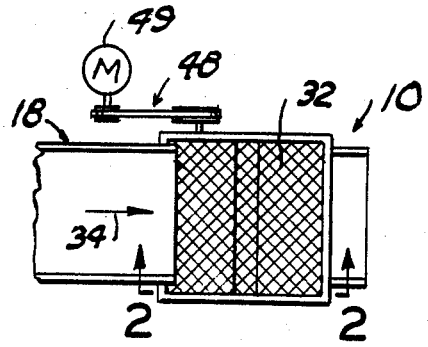
FIG. 1 is a top view of the apparatus.

Like characters of reference designate like parts in those figures of the drawings in which they occur.

In the drawings:

The reference numeral 10 indicates an upright rectangular open end housing having a removable tray 11 secured by bolts or screws 14 and normally closing the housing bottom end. The tray bottom wall 12 is transversely curved arcuately downward to enhance fluid flow as presently explained. The housing 10 is supported in a manner to permit ease in removing the tray. The tray contains a selected quantity of mercury 16. A downwardly inclined laterally extending sluice trough 18 conveys a stream of gold laden water to the housing top end. A pair of elongated equally spaced-apart fluid channel forming partition walls 19 and 20, having their upper end portions 19' and 20' secured in downward and inwardly inclined relation to the upper limit of the housing side walls 23 and 24, in cooperation with the sluice trough 18, extend downward through the housing. The pair of walls form a fluid channel 25 extending transversely of the direction of fluid flow. The pair of walls 19 and 20 maintain their spaced relationship with respect to each other while defining a tortuous path characterized by return bends. The channel wall 20 is secured to the inner surface of the side wall 24 intermediate its height, as at 26, and similarly the opposite channel wall 19 is secured to the inner surface of the opposite side wall 23, as at 28. The parallel channel walls terminate in an upward and lateral direction after the wall 20 intersects the surface of the mercury 16, as at 30. Intersection of the wall 20 with the mercury 16 forms a closed compartment 31 adjacent the wall 23 and an outlet compartment 33 of greater area than the compartment 31 adjacent the wall 24. At its lowermost position the spacing between the wall 20 and the tray bottom wall 12 forms a Venturi throat between the compartments 31 and 33.

A screen 32 having a mesh selected in accordance with the solids expected to be entrained in a water stream, for example 10 to 100-mesh, overlies the housing to collect any solids. The stream flows in the direction of the arrows 34 through the fluid channel 25. The velocity and static head of the water forces the water stream into the mercury where, during a churning contact with the mercury, an amalgamate of mercury and gold is formed. The water exits the compartment 33 through an opening 36 in the housing wall 24. Similarly a screen 37 having a desired mesh, for example 50 to 300-mesh, spans the outlet 36. The screen 37 preferably describes a one side open rectangular box disposed within the housing compartment 33 with the open side of the rectangular shape coinciding with the perimeter of the housing outlet opening 36. The purpose of the rectangular screen shape being to increase the screening surface, prevent cloging of the screen and maintain a water volumn discharge equal to the intake volume.

A paddle wheel type agitator 40 includes a horizontally disposed axle 42 extending between and journalled by opposing end walls of the housing within the compartment 31 parallel with the side wall 23. The agitator includes at least one spaced-apart paddle 44 radially secured to the axle. The position of the axle 42 is such that the agitator paddle 44 projects into the bath of mercury 16 a selected distance during angular rotation of the axle. The direction of rotation of the agitator is indicated by the arrow 46 and the purpose of the agitator is to produce a fluid churning action and induce comingling of the water in the fluid compartment 31 with the mercury 16 and to force mercury and water in the compartment 31 under the baffle and Venturi throat forming partition wall and into the fluid compartment 33 and hence out of the housing through the opening 36. At their lowermost position each of the channel walls 19 and 20 is provided with a plurality of relatively small spaced-apart apertures 35 generating jet streams by the fluid static head and also acting as drain holes.

Belt and pulley means 48 mounted on one end of the axle 42, outwardly of the housing, is connected with a drive motor 49, for angularly rotating the agitator when desired.

Obviously the invention is susceptible to changes or alterations without defeating its practicability. Therefore, I do not wish to be confined to the preferred embodiment shown in the drawings and described herein.

I claim:

1. A gravity amalgamator, comprising:

a vertically elongated upright housing having opposing side walls and an open top end and having an outlet opening in one of its side walls;

a tray having a bottom wall closing the bottom end of said housing;

mercury substantially filling said tray; and, partition means including a pair of parallel partition walls for forming oppositely disposed fluid compartments in the housing and a fluid path extending downward through said housing and communicating at its depending end with at least one of the fluid compartments, the end portion of said pair of walls, opposite the housing top end, describing an arcuate downward and upward bend in which one wall of said pair of walls intersects the level of mercury in said tray and forms a Venturi throat in combination with the tray bottom wall between the oppositely disposed fluid compartments, said pair of walls terminating in spaced relation above the level of said mercury, each wall of said pair of walls having a plurality of spaced-apart apertures at the lowermost position of the arcuate downward and upward bend.

2. The amalgamator according to claim 1 in which the partition walls are characterized by a plurality of return bends for forming an uninterrupted transverse tortuous fluid path, one wall of said pair of walls being transvertsely secured to the respective adjacent housing side wall for forming said oppositely disposed fluid compartments.

3. The amalgamator according to claim 2 and further including:

agitator means supported within one housing fluid compartment in contact with the mercury for comingling the water and mercury.

* * * * *